United States Patent [19]

Laar et al.

[11] 4,181,270

[45] Jan. 1, 1980

[54] APPARATUS FOR WINDING WEBS OF PHOTOGRAPHIC PAPER OF THE LIKE

[75] Inventors: Erwin Laar, Taufkirchen; Friedrich Ganser, Feldkirchen; Thomas Hammer, Munich, all of Fed. Rep. of Germany

[73] Assignee: AGFA-Gevaert, Aktiengesellschaft, Leverkusen, Fed. Rep. of Germany

[21] Appl. No.: 919,288

[22] Filed: Jun. 26, 1978

[30] Foreign Application Priority Data

Jun. 30, 1977 [DE] Fed. Rep. of Germany ..... 2729646

[51] Int. Cl.[2] ..... B65H 17/08; B65H 59/00

[52] U.S. Cl. ..... 242/66; 242/75.51

[58] Field of Search ..... 242/66, 65, 67.1 R, 242/67.2, 75.5, 75.51, 75.52

[56] References Cited

U.S. PATENT DOCUMENTS

| | | | |
|---|---|---|---|
| 2,120,735 | 6/1938 | Debrie | 242/75.5 |
| 3,603,521 | 9/1971 | Ormsby | 242/75.51 |
| 3,917,183 | 11/1975 | Malone | 242/66 |
| 4,063,692 | 12/1977 | Buggy | 242/75.51 |

*Primary Examiner*—Edward J. McCarthy
*Attorney, Agent, or Firm*—Peter K. Kontler

[57] ABSTRACT

Apparatus for simultaneously winding several webs of developed photographic paper on the cores of reels whose flanges rest on pairs of supporting rollers one of which is driven by a discrete variable-speed motor has a loop former for each web. Each loop former adjusts a potentiometer in dependency on changes of tensional stress upon the corresponding web, and the potentiometers cause control circuits for the corresponding motors to reduce the speed of the driven supporting rollers as the diameters of convoluted portions of the webs increase. The webs are fed at a constant speed. The supporting rollers consist of rubber to reduce the noise as a result of contact with the flanges of the respective reels, and to reduce the likelihood of slippage of the reels.

14 Claims, 2 Drawing Figures

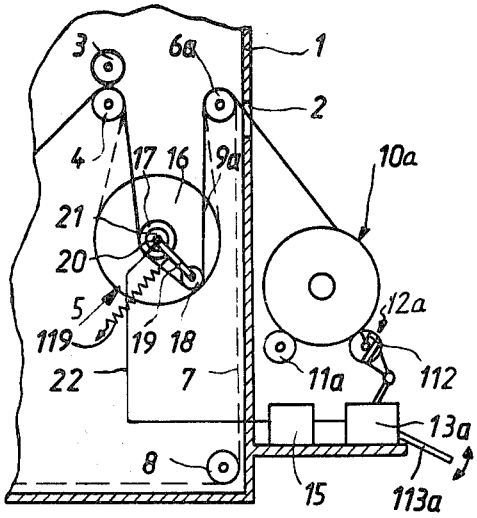
Fig.1
Fig.2
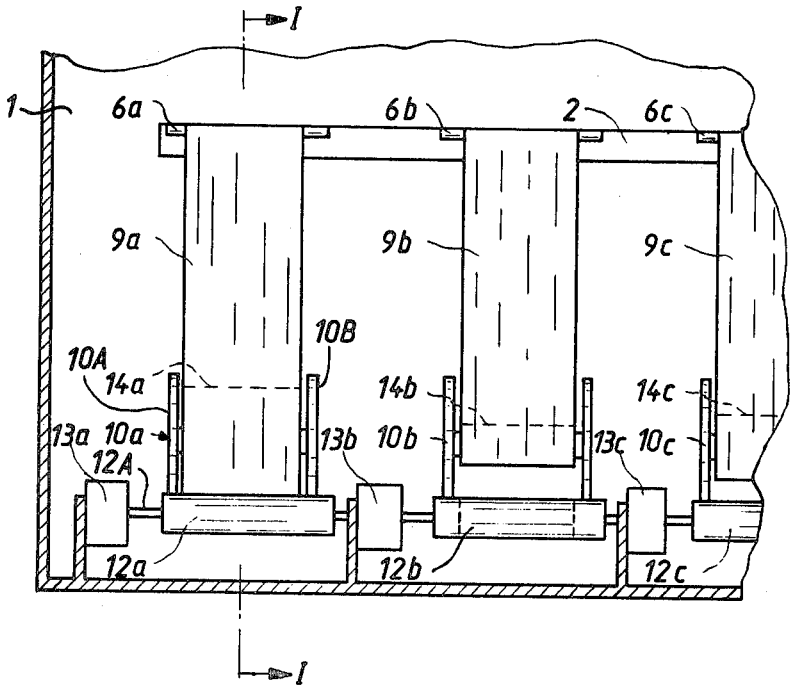

APPARATUS FOR WINDING WEBS OF PHOTOGRAPHIC PAPER OF THE LIKE

BACKGROUND OF THE INVENTION

The present invention relates to apparatus for processing webs of flexible material, and more particularly to improvements in apparatus for simultaneous processing of two or more webs. Still more particularly, the invention relates to improvements in apparatus which can be utilized for simultaneous winding of several parallel webs of exposed and developed photosensitive material, such as photographic paper which bears the images of film frames.

Webs of exposed photographic paper are transported through a developing machine wherein they undergo one or more wet treatments prior to passing through a drying chamber. The thus processed webs are thereupon wound onto reels which are transported to apparatus wherein the webs are severed to yield discrete prints which are stacked and then assembled with corresponding films or sections of films for shipment to dealers or directly to customers.

Presently known winding apparatus for webs or exposed and developed photographic paper utilize reels with a core between two flanges which are contacted by at least two rollers in order to be rotated in a direction to convolute the web onto the core. If the developing machine processes two or more webs at a time, the reels which are to collect discrete webs are supported by a pair of elongate rollers, i.e., the flanges of several reels rest on the peripheral surfaces of two parallel horizontal rollers. One of the rollers is driven to rotate the flanges. As a rule, the driven roller is a steel shaft which is rotated at a constant speed.

A drawback of the just described conventional winding apparatus is that their operation is fully satisfactory only when the leaders of all webs which are to be convoluted onto the cores of a set of reels resting on a common pair of rollers are attached to the respective reels at one and the same time, i.e., when the diameter of convoluted web stock grows at the same rate on each and every reel. However, in most instances, the leaders of webs are attached to the corresponding reels at different times so that the diameters of convoluted material vary from reel to reel. Since the RPM of the driven roller must be selected with a view to insure adequate winding of webs which are about to be wound onto the respective reels (i.e., of webs during the initial stage of winding) as well as of webs which are in an advanced stage of winding, the speed of the driven roller is rather high so that the flanges of all reels which already store relatively large supplies of convoluted web material slide with respect to the driven roller. This will be readily appreciated since the peripheral speed of flanges forming part of a reel which collects a web must decrease if the web is supplied at a constant speed. Slippage of flanges with respect to the driven roller results in pronounced wear upon such parts. Furthermore, and since such slippage is anticipated by the manufacturer, the flanges of the reels as well as the rollers which support and rotate the flanges are made of a highly wear-resistant hard material, i.e., a material which can stand long periods of use in spite of the fact that the flanges slide with respect to the peripheries of steel rollers. Continuous slippage of relatively hard flanges with respect to the rollers (or at least with respect to the driven roller) generates a very unpleasant and readily discernible noise which becomes unbearable to the employees in a photographic processing laboratory, especially if the winding apparatus is or are operated continuously or with short interruptions so that an employee hears the noise during an entire shift.

OBJECTS AND SUMMARY OF THE INVENTION

An object of the invention is to provide a novel and improved apparatus for simultaneous winding of two or more flexible strips or webs, particularly for simultaneous winding of several exposed and developed webs of photographic paper or the like.

Another object of the invention is to provide an apparatus which generates a minimum of noise and wherein the wear upon the moving parts is much less pronounced than in heretofore known apparatus.

A further object of the invention is to provide a winding apparatus which can properly collect webs regardless of whether or not the leaders of two or more webs are connected with the respective takeup reels at the same time.

An additional object of the invention is to provide the winding apparatus with novel and improved means for regulating the speed of takeup reels for discrete webs.

Another object of the invention is to provide the apparatus with novel and improved means for monitoring the diameters of convoluted webs.

A further object of the invention is to provide a winding apparatus wherein the attachment of the leaders of webs to the respective takeup reels can be entrusted to unskilled or semiskilled attendants and wherein such attachment does not involve any danger to the attendants.

The invention is embodied in an apparatus for winding several discrete webs an flanged takeup reels, particularly for winding webs of exposed and developed photographic paper. The apparatus comprises means (e.g., one or more pairs of driven rolls) for advancing the webs toward the respective reels at a first speed, and independent drive means for the flanges of each takeup reel. Each of the drive means includes means for varying the peripheral speed of the flanges of the respective takeup reel as a function of changes of the diameter of convoluted web material thereon. Each drive means further comprises a plurality of parallel supporting rollers for the flanges of the respective takeup reel, and each speed varying means comprises a variable-speed prime mover (e.g., an electric motor) for at least one of the supporting rollers. Still further, each speed varying means comprises control means for the respective prime mover and means for transmitting to the control means signals denoting the tensional stress upon the respective web intermediate the advancing means and the corresponding reel. Such signal transmitting means may comprise devices for looping the respective webs.

In accordance with a presently preferred embodiment of the invention, the looping devices comprise adjustable potentiometers and means for adjusting the potentiometers in dependency on changes of tensional stress upon the respective webs. For example, each adjusting means may comprise an arm or lever which is pivotable by the respective web about a fixed axis to an extent which is a function of the magnitude of tensional stress upon the corresponding web. The free end of each arm preferably carries an idler roller, and the respective web is trained over such idler roller. Each arm is preferably movable by gravity to a neutral position corresponding to zero speeds of the corresponding supporting rollers. Alternatively, or in addition, each looping device may comprise springs or analogous means for yieldably biasing the arms to neutral positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a transverse vertical sectional view of an apparatus which embodies the invention, the section being taken in the direction of arrows as seen from the line I—I of FIG. 2; and FIG. 2 is a front elevational view of the apparatus as seen from the right-hand side of FIG. 1, with certain parts shown in section.

DESCRIPTION OF THE PREFERRED EMBODIMENTS

Referring to FIGS. 1 and 2, there is shown a portion of an apparatus which can process several webs 9*a*, 9*b* and 9*c* of flexible material. Each of these webs is assumed to constitute a strip of exposed and developed photographic paper which must be coiled prior to transfer to a station where the webs are subdivided into discrete prints. The housing 1 of the apparatus has an outlet opening 2 through which the webs 9*a*–9*c* issue on their way toward the respective takeup reels 10*a*, 10*b* and 10*c*. As shown in FIG. 1, the means for advancing the web 9*a* toward the outlet opening 2 comprises two advancing rolls 3, 4 which are driven at a constant speed. The housing 1 may form part of a developing machine wherein the webs 9*a*–9*c* are caused to pass through one or more liquid baths and thereupon through one or more drying chambers on their way toward the nip of the advancing rolls 3, 4. The web 9*a* which advances from the rolls 3, 4 of FIG. 1 is engaged and looped by a loop forming or looping device 5 and is trained over a guide roll 6*a* which directs the web 9*a* into and through the outlet opening 2 and toward the core of the reel 10*a*. Similar or analogous looping devices are provided for the webs 9*b* and 9*c*. The advancing rolls 3, 4 can drive all three webs; however, it is equally possible to provide a discrete pair of advancing rolls for each web.

FIG. 1 further shows a threading strip 7 which participates in movements of the web 9*a* all the way to the guide roll 6*a*. At this point, the threading strip 7 is guided downwardly (in the interior of the housing 1) to travel around a further guide roll 8 and back toward the inlet of the housing. The flanges 10A, 10B of the reel 10*a* rest on two parallel horizontal supporting rollers 11*a* and 12*a* which are mounted at the exterior of the housing 1. The roller 11*a* is an idler roller. The roller 12*a* is driven by a variable-speed prime mover 13*a* (preferably a variable-speed electric motor) whose speed is regulated by a control unit, e.g., an operational amplifier 15. The roller 12*a* can be driven directly by the output element of the motor 13*a* or through the medium of a suitable step-down or step-up transmission, not shown. FIG. 2 shows that the shaft 12A for the roller 12*a* constitutes the output element of the motor 13*a*.

FIG. 2 further shows discrete guide rollers 6*b*, 6*c* for the webs 9*a*, 9*b*, discrete driven rollers 12*b*, 12*c* for the webs 9*b*, 9*c* and discrete motors 13*b*, 13*c* for the respective rollers 12*b*, 12*c*. The rollers which correspond to the roller 11*a* of FIG. 1 and cooperate with the rollers 12*b*, 12*c* to respectively support the flanges of the reels 10*b* and 10*c* cannot be seen in FIG. 2. The number of reels and of the drive means therefor can be reduced to two or increased to four or more. Furthermore, all of the webs need not have the same width. Thus, if the central web 9*b* is narrower than the web 9*a* or 9*c*, the corresponding supporting roller 12*b* can be shorter than the roller 12*a* or 12*c*. This is indicated in FIG. 2 by broken lines. Still further, the webs 9*a*–9*c* need not be disposed as far apart as shown in FIG. 2; as a rule, the paths for the webs are closer to each other.

FIG. 2 also shows (at 14*a*) that the diameter of the convoluted portion of the web 9*a* is greater than that (shown respectively at 14*b* and 14*c*) of the convoluted portion of the web 9*b* or 9*c*. For example, the material which is already convoluted on the core of the reel 10*b* may constitute one or more convolutions. The roll of convoluted material on the core of the reel 10*a* is nearly complete, i.e., the trailing end of the web 9*a* is about to reach the left-hand winding station of FIG. 2. The diameter of the convoluted portion of the web 9*c* is approximately one-third of the maximum diameter. The means for varying the peripheral speed of the flanges 10A, 10B of the reel 10*a* includes the motor 13*a*, the control unit 15 and the looping device 5. The looping device 5 comprises an adjustable potentiometer 21 mounted on a shaft 20 which is installed in the housing 1. The shaft 20 further supports a relatively large pulley 16 for the threading strip 7 and a smaller pulley 17 for the web 9*a*. The web 9*a* is further trained over a small idler roller 18 which is mounted at the free end of a lever or arm 19 fulcrumed on the shaft 20. The lever or arm 19 carries the wiper (not shown) of the potentiometer 21, i.e., the signal which is transmitted by the potentiometer 21 to the control unit 15 via conductor means 22 is a function of the angular position of the lever 19 and such angular position, in turn, is a function of the tensional stress upon the web 9*a* between the advancing rolls 3, 4 and the reel 10*a*. The pulleys 16, 17 are coaxial with the shaft 20.

The operation of the means for varying the speed of the motor 13*a* for the reel 10*a* is as follows:

The threading strip 7 advances the leader of the web 9*a* beyond the guide roll 6*a* of FIG. 1, whereupon the leader advances through the outlet opening 2 and is attached to the core of the reel 10*a* while the motor 13*a* is idle. This simplifies the task of the attendant and reduces the likelihood of injury. The threading strip 7 thereupon advances toward and over the guide roll 8 and returns toward the inlet of the housing 1. The rolls 3, 4 advance the web 9*a* at a constant speed. The motor 13*a* is started by the attendant, e.g., by depressing a foot pedal 113*a* which is shown in FIG. 1. The foot pedal 113*a* can further serve to start the drive for the advancing rolls 3 and 4.

As the diameter of convoluted web material on the core of the reel 10*a* increases, the tensional stress upon the web 9*a* between the rolls 3, 4 and the reel 10*a* also increases because the rolls 3, 4 are driven at a constant speed whereas the reel 10*a* exerts a progressively increasing tensional stress upon the web 9*a* because the driven roller 12*a* tends to rotate the flanges 10A, 10B at a constant speed while the diameter of the convoluted material (14*a*) increases with each revolution of the reel 10*a*. The length of the web 9*a* between the advancing rolls 3, 4 (which are driven at a constant speed) and the reel 10*a* decreases whereby the web 9*a* lifts the idler roller 18, i.e., the lever or arm 19 is pivoted in a counterclockwise direction, as viewed in FIG. 1, and adjusts the potentiometer 21 in a sense to enable or cause the control unit 15 to reduce the speed of the motor 13*a*. Thus, the roller 12*a* begins to rotate at a reduced speed whereby the tension upon the web 9*a* between the rollers 3, 4 and the reel 10*a* decreases.

The manner in which the speed of the motors 13*b* and 13*c* for the reels 10*b*, 10*c* is regulated is the same. Thus, the apparatus comprises three loop forming devices and three control units, one for each of the reels 10*a*, 10*b*, 10*c*.

The improved apparatus for simultaneous winding two or more running webs can be used with particular advantage in or in combination with developing machines which process webs of different widths. If desired, the axial length of each driven supporting roller may equal or slightly exceed the axial length of the largest reel which is to be used in the apparatus. This renders it possible to use any one of the three units for winding of narrower or wider webs, including webs of minimum or maximum width.

The rollers 12*a*, 12*b*, 12*c* may be made of a material with a high friction coefficient to prevent or greatly reduce slippage between these rollers and the flanges of the respective reels. This is desirable and advantageous in the apparatus of the present invention because the reels need not slip with respect to the driven supporting rolls since the control units automatically change the speed of the corresponding motors to compensate for increasing diameters of convoluted material as the winding operation progresses. For example, each of the rollers 12*a*–12*c* may consist of or may include a cylindrical sleeve 112 of elastomeric material, such as rubber or the like. The utilization of elastomeric material is desirable on the aforementioned ground, i.e., to reduce slippage of the flanges, and on the additional ground that the operation is practically noiseless.

The potentiometer 21 can be installed in such a way that the motor 13*a* is automatically arrested when the lever or arm 19 is permitted to assume its neutral position (in which it extends vertically downwardly from the shaft 20) by gravity. Such position of the lever or arm 19 indicates that the web 9*a* is under no tension at all or that the trailing end of the web 9*a* is already convoluted on the core of the reel 10*a*. A spring 119 or other suitable resilient means is preferably provided to yieldably bias the lever or arm 19 to the neutral position in which the member 19 abuts against a stop, not shown.

The foot pedal 113*a* constitutes an advantageous but optional feature of the improved apparatus. This pedal enables the attendant to start the motors while his hands remain free to perform other tasks. It is further possible to provide the apparatus with a master starting switch for all three motors 13*a*–13*c* and/or with a master switch for starting the drive for the advancing rolls. Such master switches are preferably designed in such a way that a running motor simply continues to run when the corresponding switch is actuated to start the other two motors, i.e., each of the three winding units can operate independently of the other unit or units. This contributes to versatility of the apparatus.

An important advantage of the improved apparatus is that the webs are not likely to be damaged or to break as a result of application of excessive tensional stresses. Furthermore, the wear upon the flanges of the takeup reels is negligible because these flanges merely roll along but need not slip with respect to the driven and idle supporting rollers. Furthermore, the generation of noise is reduced to a level which does not bother the attendants, even those who perform their duties in close proximity to the apparatus during an entire shift. Also, the quality of convoluted material on the cores of the reels is more satisfactory because the winding operation is carried out while the tensional stress upon the running webs varies vary little or not at all. Still further, the task of the attendant is simplified because the leaders of the webs can be attached to the cores of the respective reels while the motors are idle.

Without further analysis, the foregoing will so fully reveal the gist of the present invention that others can, by applying current knowledge, readily adapt if for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for winding several discrete webs on flanged takeup reels, particularly for winding webs of developed photographic paper, comprising means for advancing the webs toward the respective reels at a first speed; and independent drive means for the flanges of each of said reels, each of said drive means including means for varying the peripheral speed of the flanges of the respective reels as a function of changes of the diameter of convoluted web material thereon and a plurality of substantially parallel supporting rollers for the flanges of the respective reels, each of said speed varying means comprising a variable speed prime mover for at least one of said supporting rollers.

2. Apparatus as defined in claim 1, wherein each of said speed varying means further comprises control means for the respective prime mover and means for transmitting to said control means signals denoting the tensional stress upon the respective web intermediate said advancing means and the respective reel.

3. Apparatus as defined in claim 2, wherein web of said signal transmitting means comprises a device for looping the respective web.

4. Apparatus as defined in claim 3, wherein each of said looping devices comprises an adjustable potentiometer and means for adjusting said potentiometer in dependency on changes of tensional stress upon the respective web.

5. Apparatus as defined in claim 4, wherein each of said adjusting means comprises an arm which is pivotable by the respective web about a fixed axis to an extent which is a function of the magnitude of tensional stress upon such web.

6. Apparatus as defined in claim 5, wherein each of said arms comprises a roll which is remote from the respective axis, and the respective web is trained over such roll.

7. Apparatus as defined in claim 5, wherein said arms are movable by gravity to neutral positions corresponding to zero speeds of the respective driven supporting rollers.

8. Apparatus as defined in claim 5, further comprising means for biasing said arms to neutral positions corresponding to zero speeds of the respective prime movers.

9. Apparatus as defined in claim 1, wherein said rollers comprise elastic portions which contact the flanges of the respective reels.

10. Apparatus as defined in claim 9, wherein said elastic portions consist of rubber.

11. Apparatus as defined in claim 1, wherein each of said speed varying means further comprises means for arresting the corresponding prime mover when the tensional stress upon the respective web decreases to a predetermined minimum value.

12. Apparatus as defined in claim 1, further comprising means for simultaneously starting said prime movers.

13. Apparatus as defined in claim 12, wherein said starting means comprises a foot pedal.

14. Apparatus as defined in claim 1, wherein the length of supporting rollers for at least one of said reels exceeds the length of supporting rollers for another of said reels.

* * * * *